US008251124B2

(12) United States Patent
Hirata et al.

(10) Patent No.: US 8,251,124 B2
(45) **Date of Patent: *Aug. 28, 2012**

(54) MOLDING MACHINE

(75) Inventors: Minoru Hirata, Toyokawa (JP); Takayuki Komiyama, Toyokawa (JP); Toshihiko Oya, Toyokawa (JP); Tsuyoshi Sakai, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 177 days.

This patent is subject to a terminal disclaimer.

(21) Appl. No.: 12/516,647

(22) PCT Filed: Jun. 22, 2007

(86) PCT No.: PCT/JP2007/063058

§ 371 (c)(1),
(2), (4) Date: May 28, 2009

(87) PCT Pub. No.: WO2008/075474

PCT Pub. Date: Jun. 26, 2008

(65) Prior Publication Data

US 2010/0071867 A1 Mar. 25, 2010

(30) Foreign Application Priority Data

Dec. 18, 2006 (JP) ..... 2006-339533

(51) Int. Cl.
*B22C 17/12* (2006.01)
*B22C 17/08* (2006.01)
*B22C 15/28* (2006.01)

(52) U.S. Cl. ..... 164/184; 164/172; 164/194; 164/201

(58) Field of Classification Search ..... 164/20, 164/29, 37, 169, 172, 184, 194, 200–202
See application file for complete search history.

(56) References Cited

U.S. PATENT DOCUMENTS 3,828,840 A * 8/1974 Lund et al. ..... 164/195
5,246,058 A * 9/1993 Murata ..... 164/182
5,927,372 A * 7/1999 Moribe et al. ..... 164/20
6,957,687 B2 10/2005 Hirata et al.

(Continued)

FOREIGN PATENT DOCUMENTS

EP 0 836 900 A1 4/1998
EP 1 695776 A1 8/2006
EP 1 726 382 A 11/2006
EP 1 837 099 A2 9/2007

(Continued)

*Primary Examiner* — Jessica L Ward
*Assistant Examiner* — Kevin E Yoon
(74) *Attorney, Agent, or Firm* — Finnegan, Henderson, Farabow, Garrett, & Dunner, L.L.P.

(57) ABSTRACT

A molding machine that defines upper and lower mold cavities while cope and drag flasks, having a match plate sandwiched therebetween, are rotated from a horizontal position to a vertical position. An upper squeeze member is insertable into the cope flask. A pressure-applying plane of the upper squeeze member defines an upper mold cavity together with the match plate and the cope flask. A pivoting frame supports the cope and drag flasks, having a match plate sandwiched therebetween, and the upper squeeze member, such that they rotate in unison between a horizontal position to a vertical position. A fixed filling frame abuts the drag flask when the cope and drag flasks are in the vertical position. A lower squeeze member has a pressure-applying plane that is oriented horizontally. The pressure-applying plane of the lower squeeze member defines a lower mold cavity together with the match plate, the drag flask, and the filling frame.

8 Claims, 9 Drawing Sheets

U.S. PATENT DOCUMENTS

| | | | | |
|---|---|---|---|---|
| 7,594,532 | B2 * | 9/2009 | Hirata et al. | 164/456 |
| 7,654,303 | B2 | 2/2010 | Hirata et al. | |
| 7,681,624 | B2 * | 3/2010 | Hirata et al. | 164/184 |
| 2007/0175607 | A1 * | 8/2007 | Hirata et al. | 164/29 |
| 2007/0227684 | A1 * | 10/2007 | Hirata et al. | 164/37 |

FOREIGN PATENT DOCUMENTS

| | | | |
|---|---|---|---|
| JP | 04-066245 | | 3/1992 |
| WO | WO 00/50187 | | 8/2000 |
| WO | WO 2005/089983 | A1 | 9/2005 |
| WO | WO 2005105339 | A1 * | 11/2005 |

* cited by examiner

MOLDING MACHINE

FIELD OF THE INVENTION

This invention relates to a molding machine, more particularly, one to mold upper and drag flaskless molds at the same time.

BACKGROUND OF THE INVENTION

In the flaskless molding method, an attempt has been made to improve work efficiency by using a well-known flaskless molding machine. For example, Japanese Early-Patent Publication No. 04-66245 suggests that a well-known flaskless molding machine be combined with a pattern change device. The pattern exchanges mechanically and automatically, rather than manually, a used pattern plate that is used to form molds in the molding machine, for a new pattern plate.

However, the flaskless molding machine employed as in the above disclosure is well known, and has also been used in a conventional flaskless molding method, where the pattern plates are exchanged manually. Therefore, this disclosure and the conventional flaskless molding method, where the pattern plates are manually exchanged, are the same as in the processes of forming a pair of mold cavities with the flaskless molding machine. That is, a pattern plate having patterns on both faces is horizontally clamped between a pair of flasks in a sandwich relationship at the side of the molding machine. They are then rotated in unison to a location below a sand supplying device such that they are vertical. Then a pair of opposed squeeze heads is horizontally inserted in the pair of the vertical flasks, which between them clamp the pattern plate, to define a pair of mold cavities. Accordingly, in the conventional flaskless molding machine the processes of forming a pair of mold cavities could not begin until the cope and drag flasks that clamp the match plate therebetween are in the vertical position. Because this situation results in a molding cycle in the conventional flaskless molding machine that still requires much time, the production efficiency of molds is low.

SUMMARY OF THE INVENTION

Accordingly, this invention aims to provide a molding machine that can shorten the time required to form flaskless molds, and that can increase production efficiency.

The present invention provides a molding machine to mold a pair of flaskless molds. This molding machine comprises a first flask and a second flask; an exchangeable match plate having a first face and a second face corresponding to the first flask and the second flask, wherein the match plate is adapted to be held between the first flask and the second flask in a sandwich relationship; means for relatively moving either or both of the first flask and the second flask to the match plate such that the first and second flasks can hold and release the match plate therebetween; a first squeeze member having a first pressure-applying plane, wherein the first squeeze member is insertable into the first flask with the first pressure-applying plane being opposed to the first face of the match plate, and wherein the first squeeze member is inserted into the first flask when the first flask and the second flask hold the match plate in a sandwich relationship therebetween to define a first mold cavity by the first pressure-applying plane, the first face of the match plate, and the first flask; supporting means for supporting the first flask, the second flask, the match plate, and the first squeeze member, and for rotating them in unison between a horizontal position in which the first flask and the second flask hold the match plate therebetween in the sandwich relationship with the first pressure-applying plane of the first squeeze member being oriented vertically and downward, and a vertical position in which the first pressure-applying plane is oriented horizontally; a filling frame located to abut the second flask in a perpendicular position in the filling frame when the first and second flasks hold the match plate therebetween in the sandwich relationship at the vertical position; a second squeeze member having a second pressure-applying plane that is oriented horizontally, wherein the second squeeze member is insertable into the filling frame, and wherein the second squeeze member is insertable into the second flask through the filling frame when the first and second flasks hold the match plate therebetween with the second pressure-applying plane being opposed to the second face of the match plate at the vertical position to define a second mold cavity by the second pressure-applying plane, the second face of the match plate, the filling frame, and the second flask; a first actuator to move the first squeeze member to the first face of the match plate such that molding sand within the first mold cavity is squeezed by the first pressure-applying plane of the inserted first squeeze member; and a second actuator to move the second squeeze member to the second face of the match plate such that molding sand within the second mold cavity is squeezed by the second pressure-applying plane of the second squeeze member.

In one embodiment of the present invention, the first flask is a cope flask, and the second flask is a drag flask.

Preferably, the first mold cavity is defined by the first pressure-applying plane of the first squeeze member, the first face of the match plate, and the first flask, while the first and second flasks, the match plate, and the first squeeze member are rotated from the horizontal position to the vertical position.

In this case, the second squeeze member initiates the insertion into the filling frame while rotating from the horizontal position to the vertical position. The second mold cavity is then defined by the second pressure-applying plane of the second squeeze member, the second face of the match plate, and the second flask when the filling frame abuts the second flask.

Each first or second actuator may be a hydraulic cylinder or an electrical cylinder.

The first and second flasks may have sand filling ports on their sidewalls for supplying molding sand. In this case, the molding machine further includes means for introducing by air the molding sand into the defined first and second mold cavities through the sand filling ports.

The means for introducing the molding sand may include a device for fluidizing the molding sand with an airflow of compressed air.

The molding machine may further include a shuttle for carrying in and carrying out the match plate between the first flask and the second flask at the horizontal position.

The molding machine may further include means for stripping a pair of the molds from the first and second flasks.

Preferably, the means for stripping a pair of the molds includes means for pushing out the molds from the first flask and the second flask, which are in a stacked relationship, and which contain a pair of the molds.

The above and other features and objects of the present invention are further clarified by the following descriptions that refer to the accompanying drawings.

BRIEF DESCRIPTIONS OF THE DRAWINGS

Figure 1:
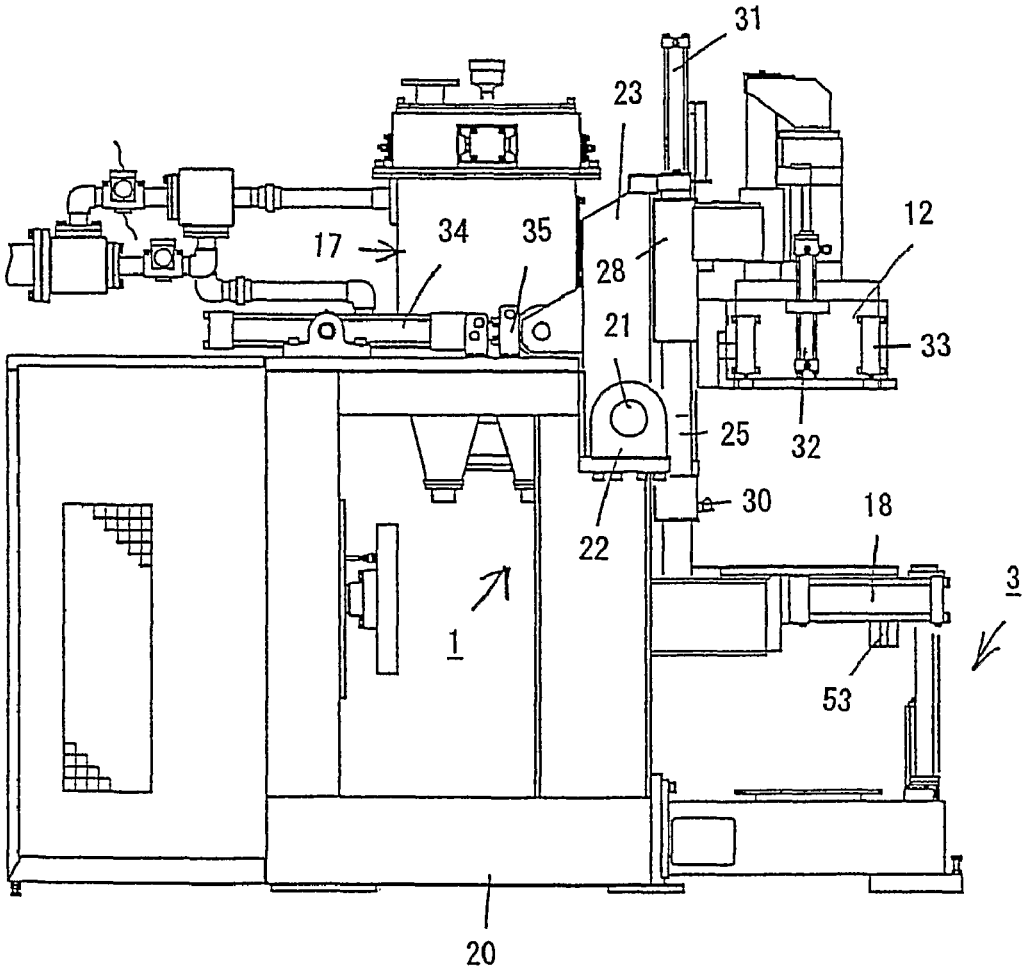
FIG. 1 is a front view of the molding machine of an embodiment of the present invention.

FIGS. 7(A)-(D) illustrate the continuous process of molding a pair of molds with the molding machine of FIG. 1.

FIGS. 8(A)-(D) illustrate the continuous process of removing a match plate from a pair of flasks with the molding machine of FIG. 1.

FIGS. 9(A), (B), and (C) illustrate the continuous process of stripping a pair of molds from a pair of flasks with the molding machine of FIG. 1.

DESCRIPTIONS OF THE PREFERRED EMBODIMENT

FIGS. 1 to 4 show one embodiment of the flaskless molding machine of the present invention. The flaskless molding machine generally includes a main unit 1 on a machinery mount 20 of the machine, a shuttle 2 (FIG. 3) for carrying in and carrying out a match plate 11 (FIG. 2) between an cope flask 12 and a drag flask 13 of the main unit 1, and a mold stripping equipment 3 for stripping the resulting upper and lower molds that are molded in the main unit 1 from the cope and the drag flasks 12 and 13. Both faces of the match plate 11 are mount with patterns.

1. Main Unit of Molding Machine

Figure 2:
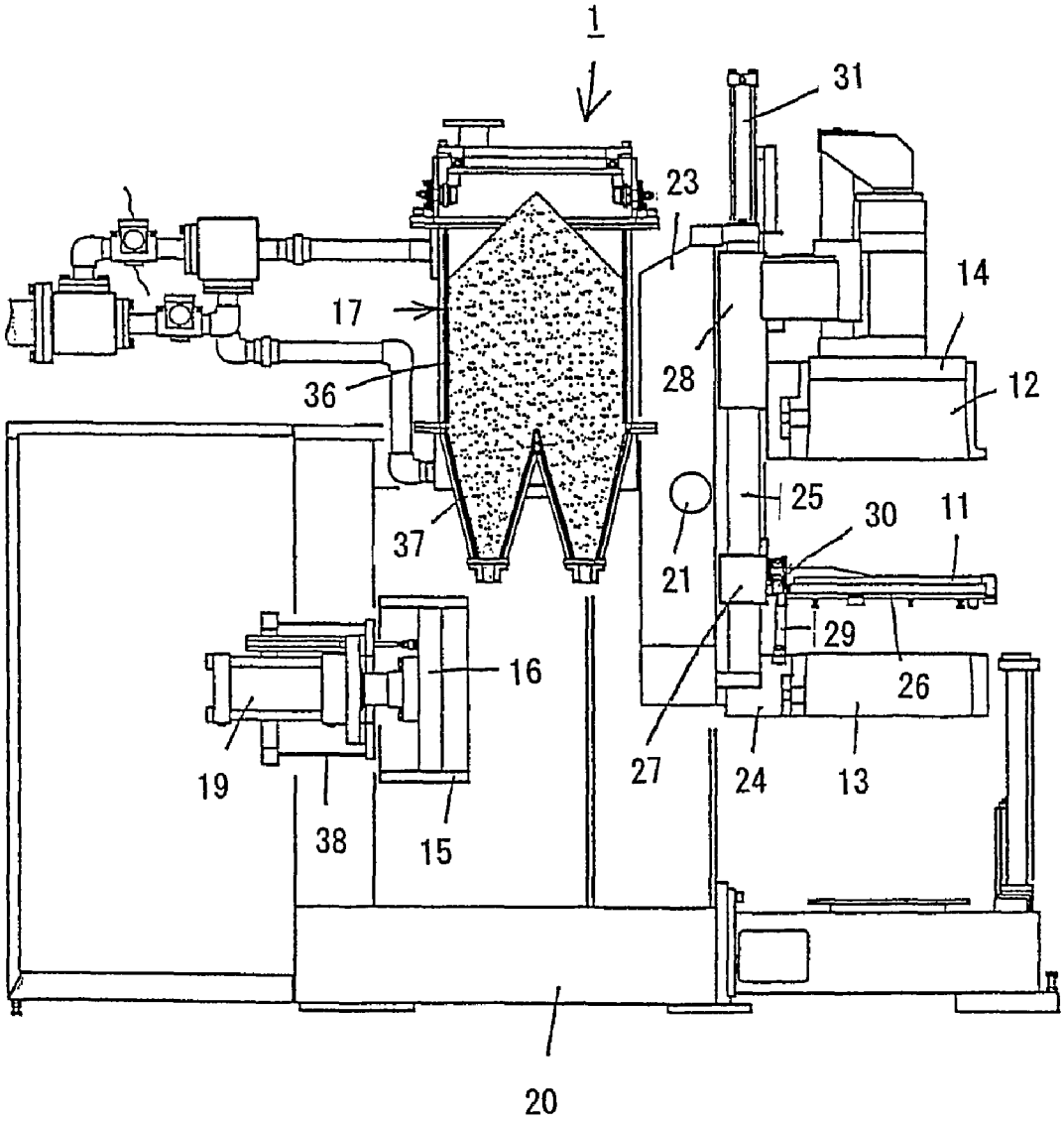
FIG. 2 is a front view, partly in cross section, of the molding machine of FIG. 1.
Figure 3:
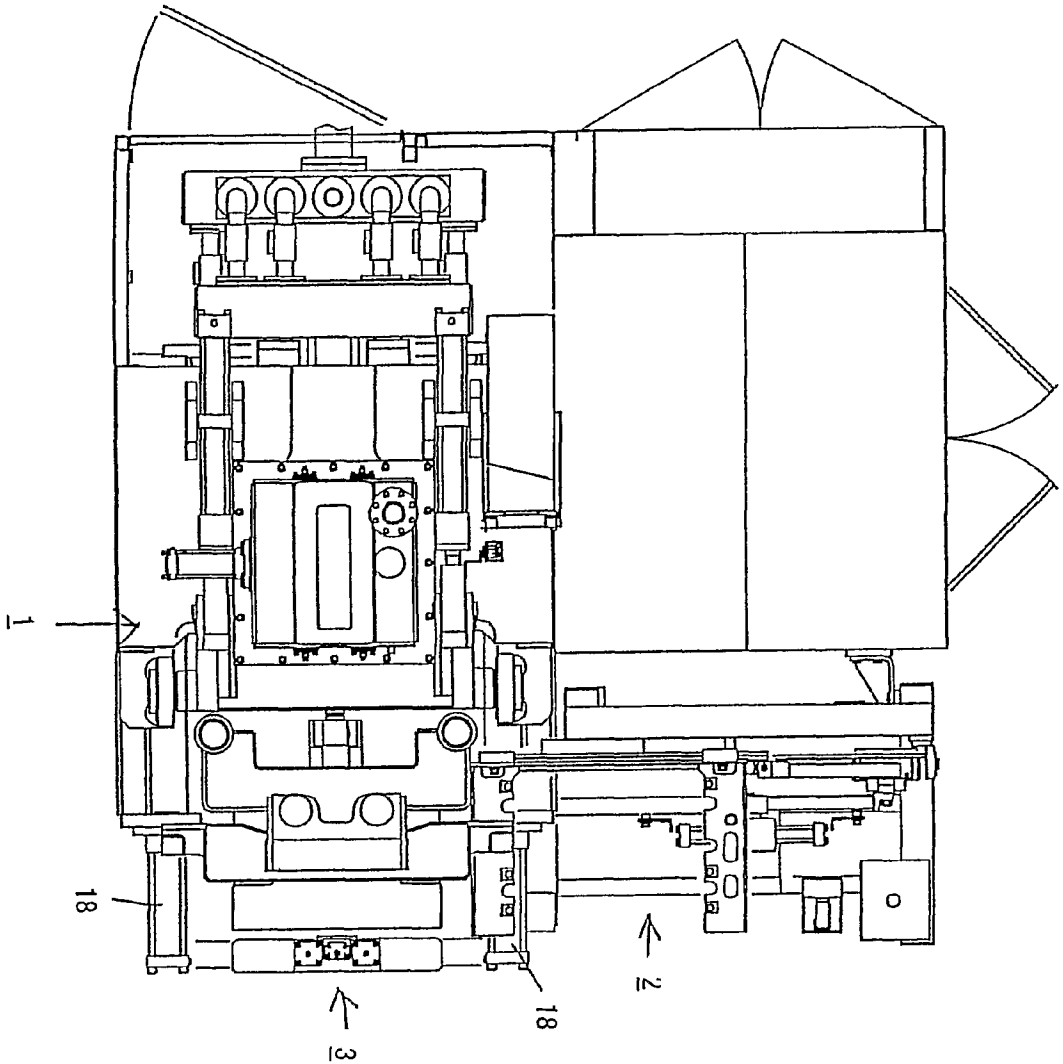
FIG. 3 is a top view of the molding machine of FIG. 1.

On the molding machine of the present invention, first the main unit 1 of it will be described. As is best shown in FIG. 2, the main unit 1 includes the cope flask (a first flask) 12 and the drag flask (a second flask) 13, which can clamp and hold the match plate 11 therebetween, an upper squeeze member 14 that is insertable in the cope flask to oppose the upper plane of the match plate 11, a filling frame 15 that is attached to the machinery mount 20 in its vertical position, and a lower squeeze member 16. The squeeze plane of the lower squeeze member 16 is oriented horizontally such that it is insertable into the filling frame 15.

FIG. 2 illustrates the initial state of the main unit 1. In this state, the match plate 11, the cope flask 12, the drag flask 13, and the upper squeeze member 14 are in their horizontal positions, where the squeeze plane of the upper squeeze member 14 is oriented to point downward in the vertical direction. The match plate 11, the cope flask 12, the drag flask 13, and the upper squeeze member 14 can be rotated to their vertical positions in unison, as described in more detail below.

In contrast, neither the filling frame 15 nor the lower squeeze member 16 can be rotated, and thus they are oriented and attached horizontally. The filling frame 15 is attached to the position in which it abuts the drag flask 13 when the cope flask 12, the drag flask 13, and the match plate 11 sandwiched therebetween, have been rotated in their vertical positions. The lower squeeze member 16 can be inserted into the drag flask 13 in its vertical position through the filling frame 15.

Arranged in the upper-center part of the main unit 1 is a sand supplying device 17 for filling molding sand into a pair of mold cavities to be defined below the sand supplying device 17. (In the state as in FIGS. 1 and 2, the mold cavities have not yet been defined.)

Below and near the sand supplying device 17, a pair of first, transverse, cylinders (upper cylinders) 18 (shown in FIGS. 1, 3, and 4) and a second, transverse, cylinder (a lower cylinder) 19 are opposed and arranged such that they operate the corresponding upper and lower squeeze members 14 and 16. Although the first and second cylinders 18 and 19 of this embodiment are hydraulic cylinders, each cylinder may be replaced with an electric cylinder.

As shown in FIGS. 1 and 2, a rotating axis 21 is arranged at the upper right on the machinery mount 20 and extended in the crosswise direction of a main unit 1 (the normal line against FIGS. 1 and 2). Therefore, the rotating axis 21 is just shown with its forward end in FIGS. 1 and 2. The rotating axis 21 is rotatably mounted in a pair of bearings 22 (just a front bearing 22 is shown in FIG. 1), which are mounted on the machinery mount 20 at a predetermined interval therebetween in the crosswise direction. Attached at about the center of the length, the rotating axis 21 is a pivotable frame 23, which is extended substantially vertically.

As best shown in FIG. 2, the drag flask 13, which left wall has holes to fill molding sand, is mounted on the bottom of the right side of the pivoting frame 23 via a supporting member 24.

On the right side of the pivoting frame 23, a pair of guide rods 25 (FIGS. 1 and 2 illustrate just the front guide rod 25) is attached at a predetermined interval therebetween in the crosswise direction such that they extend substantially vertically.

As shown in FIG. 2, a carrier plate 26, on which the match plate 11 will be placed, is slidably supported on the vertical guide rods 25 via a guide holder 27 above the drag flask 13. Above the carrier plate 26, the cope flask 12, whose left wall has holes to fill molding sand, is also slidably supported on the vertical guide rods 25 via a guide holder 28. The carrier plate 26 is moveably supported on a guide rail 30, which is extended in the crosswise direction of the machine. The guide rail 30 can be moved up and down by a telescopic motion of a third cylinder 29 mounted on the pivoting frame 23. The cope flask 12 is attached to a fourth, downwardly moving, cylinder 31 via a supporting member (not shown). The distal end of the piston rod of the fourth cylinder 31 is attached to the pivoting frame 23 such that the cope flask 12 can be moved forward and backward relative to the carrier plate 26 by a telescopic motion of the fourth cylinder 31.

As shown in FIG. 1, a pair of fifth cylinders 32 is mounted on the center positions on both sides of the cope flask (just the front side of it is shown in FIG. 1). The upper squeeze member 14 is suspended between the distal ends of the piston rods of the fifth cylinders 32 such that the upper squeeze member 14 can be moved forward and backward relative to the cope flask 12 by telescopic motions of the fifth cylinders 32. The fifth cylinders 32 thus can be rotated in unison with the cope flask 12 and the upper squeeze member 14.

Mounted on the corners of the back and front sides of the cope flask 12 are two pairs of sixth, downwardly-facing, cylinders 33. They push away the cope flask 12 from the match plate 11. Mounted on the back and front sides of the drag flask 13 (FIG. 2) are four of seventh, upwardly-moving, cylinders 53. They push away the drag flask 13 from the match plate 11. Alternatively, two of the seventh cylinders 53 may be omitted by replacing their functions with those of the third cylinder 29. Mounted on the front and rear sides of the upper plane of the machinery mount 20 is a pair of eighth, right-facing, cylinders 34. The upper part of the pivoting frame 23 is coupled between the distal ends of the piston rods of the eighth cylinders 34 via a coupling mechanism 35 such that the pivoting frame 23 pivotingly moves up and down about the rotating axis 21 by a telescopic motion of the eight cylinders 34.

The filling device 17 of the main unit 1 is located on the machinery mount 20 between the pair of the eight cylinders 34, as shown in FIG. 1. As shown in FIG. 2, attached below a sand tank 36 of the filling device 17 is a blowing nozzle 37 for supplying compressed air to fluidize molding sand.

Figure 5:
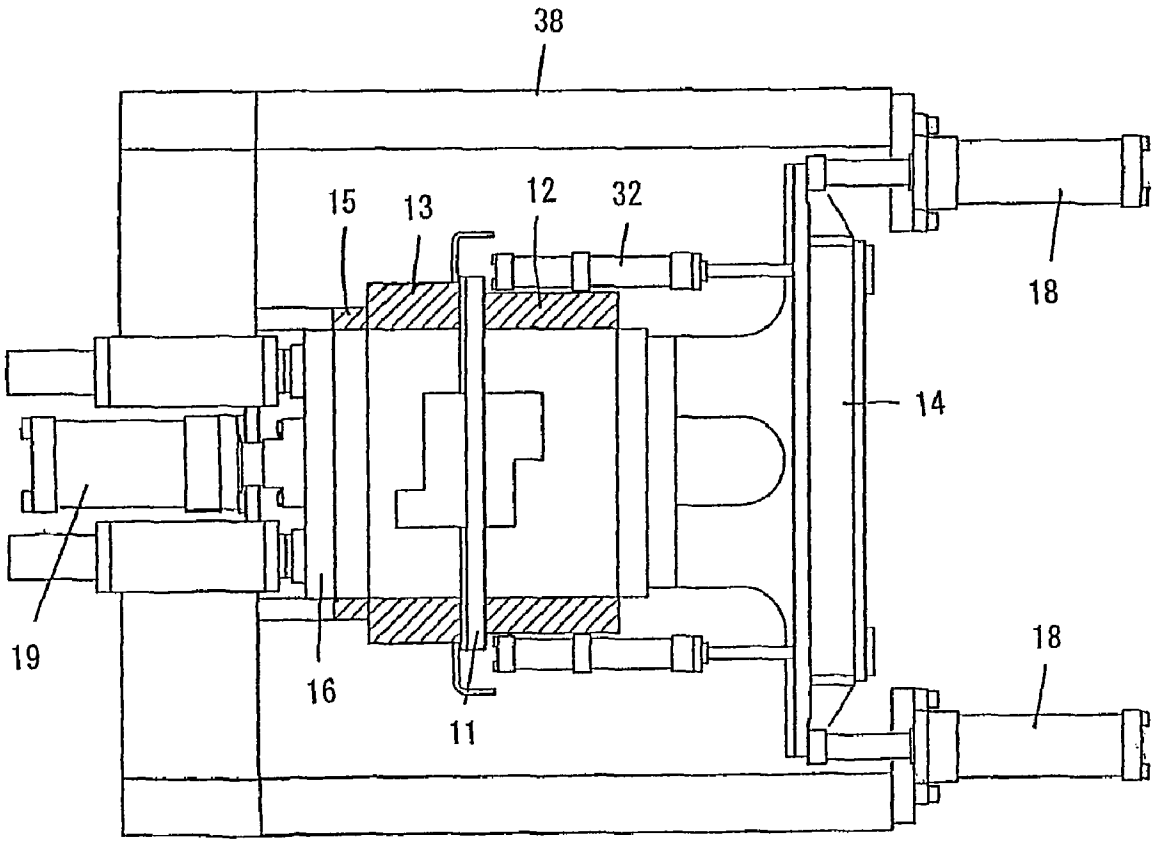
FIG. 5 is a top view of the molding machine of FIG. 1 with a pair of mold cavities defined by the molding machine and related elements.
Figure 6:
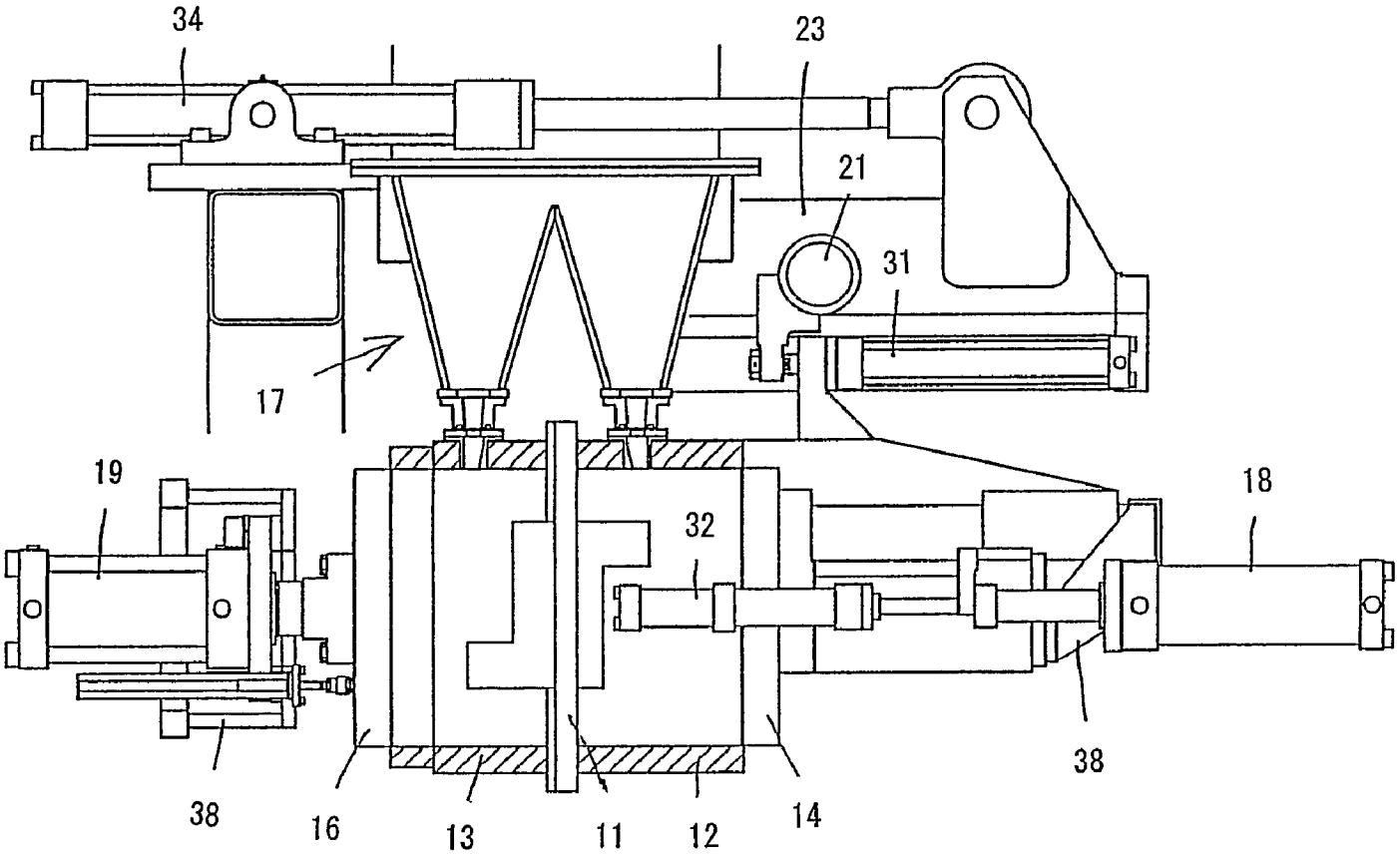
FIG. 6 is a front view, partly in cross section, of the molding machine of FIG. 1 with a pair of mold cavities defined by the molding machine and related elements.

FIG. 5 (the plane view) and FIG. 6 (the front elevational view) illustrate the arrangement wherein the match plate 11, the cope and drag flasks 12 and 13, the higher and lower squeeze members 14 and 16, and the filling frame 15, define the upper and lower mold cavities in the state shown in FIGS. 1 and 2, as in the above-described manner. Thus the mold cavities and their associated elements are rotated immediately beneath the filling device 17. In FIGS. 5 and 6, a support framework 38, which plane cross section forms a substantially "C" shape, is installed in a machinery mount 20 (FIGS. 1 and 2) under the filling device 17 (FIG. 6).

As best shown in FIG. 5, the filling frame 15 in its vertical position is fixed to the inside of a left-side frame of the support framework 38 such that the filling frame 15 will abut the drag flask 13 when the lower mold cavity is defined. The second single cylinder 19, which is mentioned above, is mounted on the center portion of the left-side frame of the support frame unit 38 such that the second cylinder 19 faces rightward. The distal end of the piston rod of the second cylinder 19 is fixed to the lower squeeze member 16 in its vertical position. Each first cylinder 18, which is mentioned above, is mounted on a pair of the open ends of the support frame 38 such that each first cylinder 18 faces left.

2. Shuttle for Match Plate

The shuttle 2 of the molding machine of the present invention will now be described. The shuttle 2 is located behind the main unit 1 shown in FIGS. 1 and 2.

Figure 4:
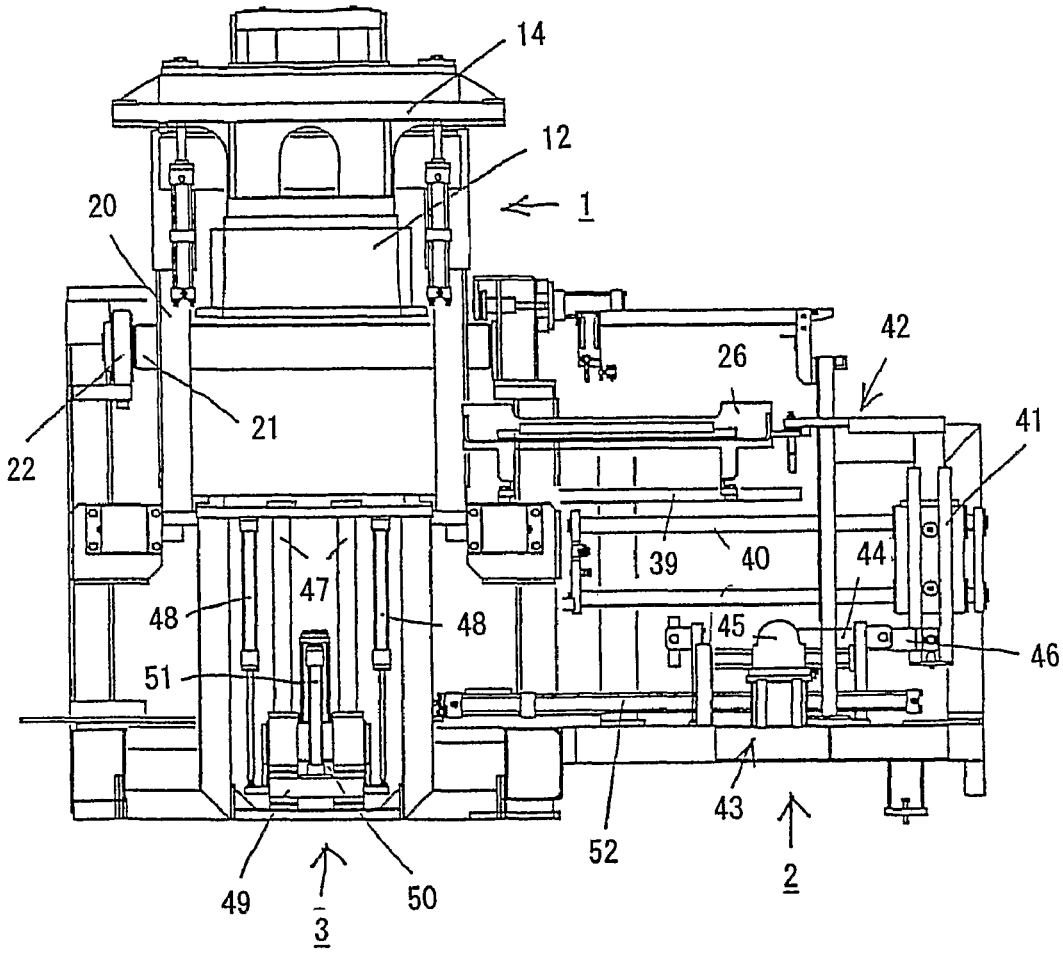
FIG. 4 is a right-side view of the molding machine of FIG. 1.

As shown in FIG. 4 (the right-side view of the molding machine), the shuttle 2 includes a rail 39 for leading the carrier plate 26 for the match plate 11 (FIG. 2) into a space between the cope flask 12 and the drag flask 13. The shuttle 2 also includes two horizontal tie bars 40. They extend forward and backward (this corresponds to the lateral direction in FIG. 4) of the machine. They are mounted on the machinery mount 20 of the main unit 1 with a predetermined interval therebetween in the vertical direction under the rail 39. The shuttle 2 also includes a connector 42 for detachably connecting rails 41 to the carrier plate 26.

The shuttle 2 also includes a driving mechanism 43 for reciprocately moving the rails 41 along the tie bars 40. The driving mechanism 43 includes a driver 45 having a pivoting arm 44 that can pivot forward and backward. The distal end of the pivoting arm 44 is supported on the roller 46. The roller 46 is received in between the pair of rails 41. By driving the driver 45 the reciprocating and pivoting motion of the pivoting arm 44 causes the carrier plate 26 to reciprocately move forward and backward via the rails 41. Alternatively, the roller 46 and rails 41 may be replaced by any sliding members.

3. Mold Stripping Equipment

The mold stripping equipment 3, for stripping the flasks of the molding machine of the invention, will now be described. The mold stripping equipment 3 is arranged at the lower-right part in FIGS. 1 and 2.

As shown in FIG. 4, the mold stripping equipment 3 has two vertical guide rods 47, which are mounted on the base of the machinery mount 20 at a predetermined interval in the crosswise direction (this corresponds to the lateral direction in FIG. 4) of the machine. A frame 49 that moves up and down is slidably mounted on the vertical guide rods 47. Suspended from the machinery mount 20 is a pair of ninth, downwardly-facing, cylinders 48, whose piston rods are attached to the frame 49 that moves up and down so as to move it up or down by contracting the ninth cylinders 48.

Located above the frame 49 that moves up and down of the mold stripping equipment 3 is a receiver 50 for receiving the stacked upper and lower molds, which are stripped from the stacked cope and drag flasks 12 and 13. The receiver 50 is supported on the distal end of the piston rod of a tenth, upwardly-facing, cylinder 51 mounted on the frame 49 that moves up and down. The receiver 50 thus further rises by the expansion of the tenth cylinder 51 after the receiver 50 and the frame 49 that moves up and down have been raised in unison by the contraction of the ninth cylinders 48. The mold stripping equipment 3 also includes an extruder 52 for extruding the stacked upper and lower molds onto the receiver 50.

Process for Molding an Upper Mold and a Lower Mold with the Molding Machine

Figure 8:
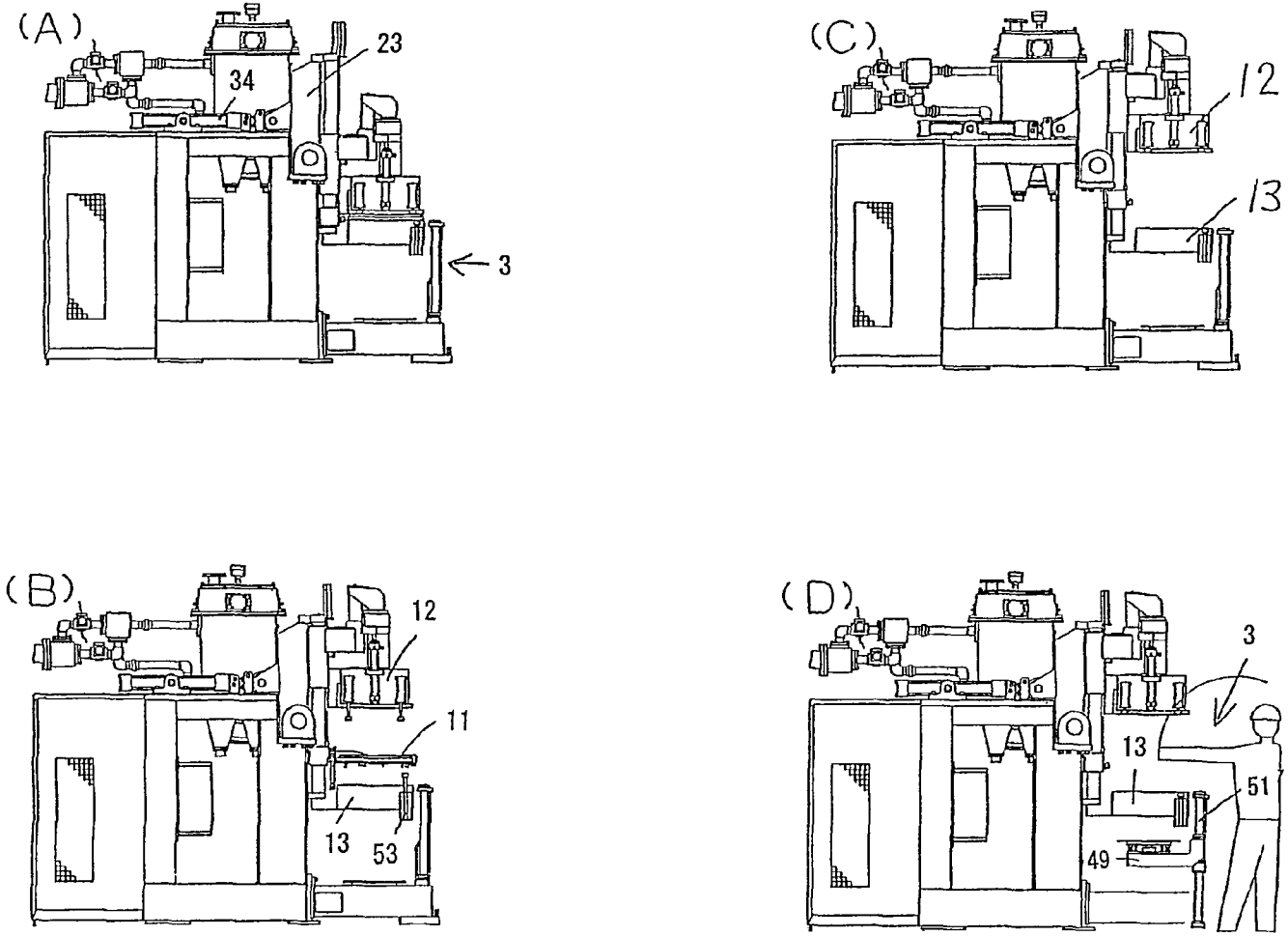
Figure 9:
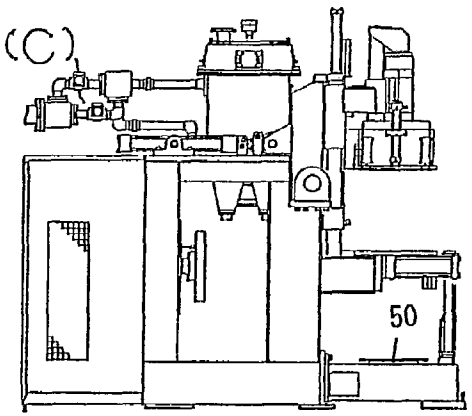
Figure 9:
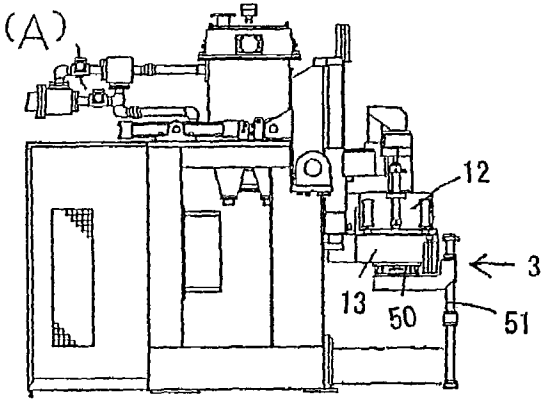
Figure 9:
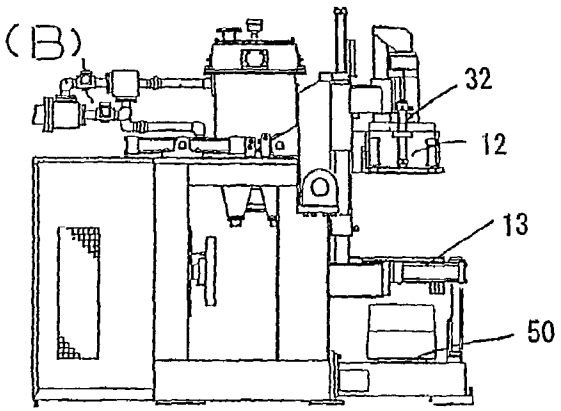

By referring to FIGS. 7, 8, and 9, the procedure will now be explained for molding an upper flaskless mold and a lower flaskless mold in their stacked state as shown FIGS. 1 and 2, using the molding machine as shown in FIGS. 1-6 of the present invention.

First, the fourth, downwardly-facing, cylinder 31 of the main unit 1 is contracted such that the drag flask 13, the match plate 11, and the cope flask 12 overlap in this order in their horizontal positions. Consequently, the match plate 11 is sandwiched and held between the cope flask 12 and the drag flask 13 (FIG. 7 (A)).

The first cylinder 18 of the main unit 1 is then contracted, while the pair of the eight cylinders 34 of the main unit 1 are extended to rotate the pivoting frame 23 clockwise about the rotating axis 21. Consequently, the cope flask 12 and the drag flask 13, with the match plate 11 sandwiched therebetween, and the upper squeeze member 14, are transported between the first cylinder 18 and the filling frame 15 in their vertical positions. Simultaneously with this rotation, or pivoting motion, the second cylinder 19 is extended in a predetermined range, and the pair of the fifth cylinders 32 is contracted, to begin defining the upper and lower mold cavities as shown in FIG. 5. More particularly, at the state where the cope flask 12 and the drag flask 13 sandwich and hold the match plate 11 therebetween, the upper squeeze member 14 is inserted in the cope flask 12 opposite the match plate 11, and thus the upper mold cavity is defined. Because the cope flask 12 and the drag flask 13, with the match plate 11 sandwiched therebetween, the upper squeeze member 14, and the associated fifth cylinders 32 for driving it, can be rotated in unison, the upper mold cavity can be defined during its rotating motion. At the same time as this rotating motion occurs, the second cylinder 19 is extended such that the lower squeeze member 16 is inserted through the filling frame 15 and the approaching drag flask 13. Its approaching is caused by the rotating motion in its substantially vertical position. The lower mold cavity is also defined when the rotating motion has been completed and thus the drag flask 13 abuts the filling frame 15 (FIG. 7 (B)). This means that the time required for defining the mold cavities and thus for molding molds can be considerably shortened compared to the conventional molding machine.

Compressed air is then supplied from a source (not shown) into the injector 37, which injects the air for fluidizing the molding sand, of the sand tank 36, to fill the upper and lower mold cavities with the molding sand by means of the injected air (FIG. 7(C)). Preferably, but not a limiting aspect of the present invention, to shorten the time needed to fill the mold cavities with the molding sand, the compressed air may also be introduced in the sand tank 36 during the filling of the molding sand.

Figure 7:
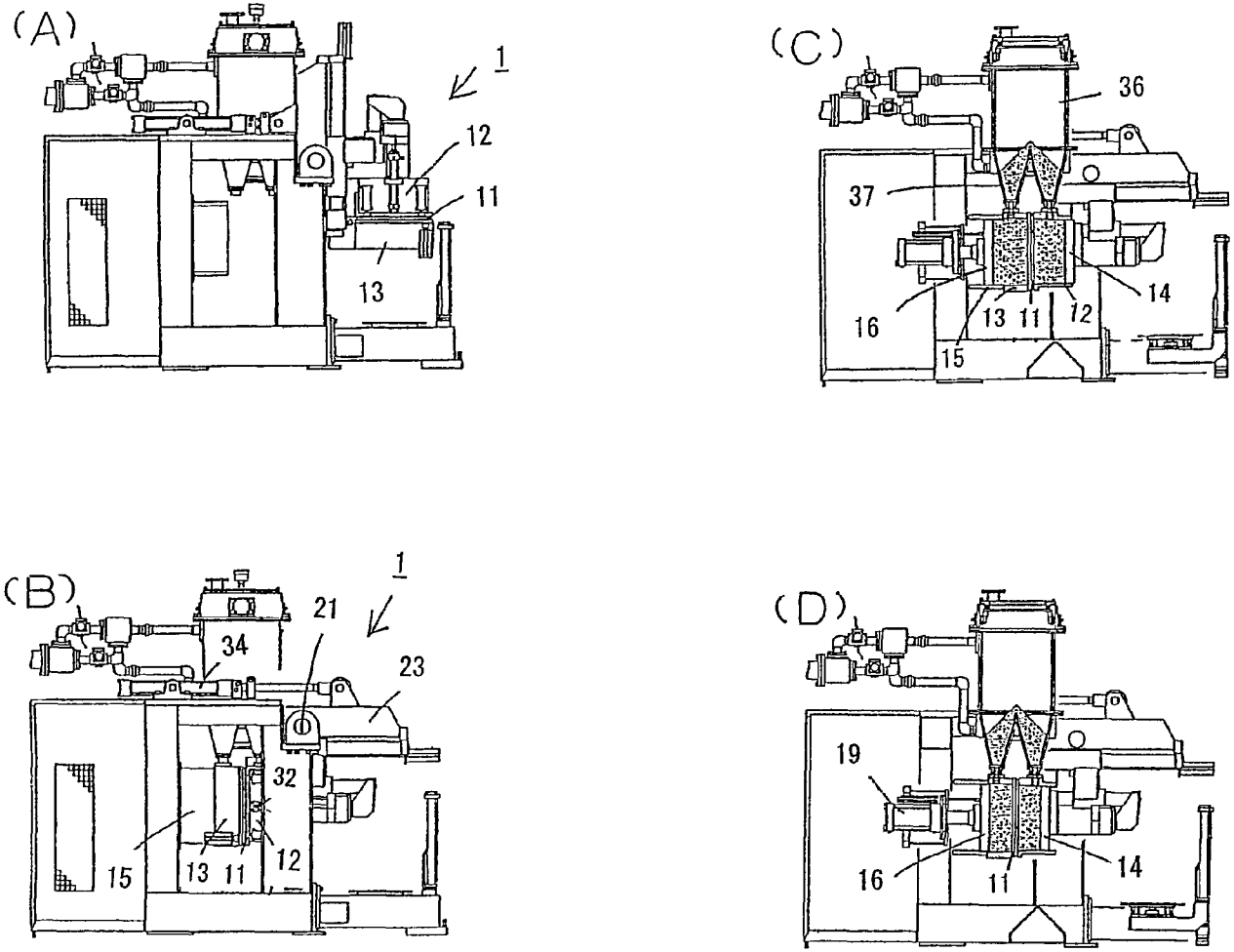

The first cylinders 18 and the second cylinders 19 are then extended to move the upper squeeze member 14 and the lower squeeze member 16 into the match plate 11 to squeeze the molding sand within the upper and lower mold cavities (FIG. 7 (D)). This squeezing process molds an upper mold and a lower mold within the upper and lower mold cavities.

The eighth cylinders 34 are then contracted to swivel the pivoting frame 23 counterclockwise, to transfer the cope flask 12 and the drag flask 13, which are contained within the corresponding upper mold and the corresponding lower mold, to the mold stripping equipment 3 (FIG. 8(A)).

The fourth cylinder 31 is then contracted to lift the cope flask 12, while the sixth cylinders 33 are extended to push away the match plate 11 from the cope flask 12. At the same time, the seventh cylinders 53 are extended to push away the match plate 11 from the drag flask 13 (FIG. 8(B)). In this step, preferably the increasing velocity of the cope flask 12 caused by the contraction of the fourth cylinder 31 is about twice the velocity of the separation, in which the match plate 11 is separated from the drag flask 13 by the extensions of the sixth and seventh cylinders 33 and 53. This results in the velocity of the separation, in which the match plate 11 is separated from the cope flask 12, being able to be substantially the same as that in which the match plate 11 is separated from the drag flask 13.

The driver 45 of the driving mechanism 43 is then operated to reversely rotate the pivoting arm 44 such that the rail 41 and the carrier plate 26 reciprocatingly move crosswise to remove the match plate 11 from between the cope flask 12 and drag flask 13 (FIG. 8(C)).

The ninth cylinders 48 of the mold stripping equipment 3 are then contracted to raise the frame 49 that goes up and down, to raise the tenth cylinder 51, and to raise the associated parts (FIG. 8(D)). Prior to this raising step, a core may be manually set in the mold within the drag flask 13 by an operator, if desired, as diagrammatically illustrated in FIG. 8(D).

The fourth cylinder 31 is then contracted to lower the cope flask 12 so as to stack it on the drag flask 13. The tenth cylinder 51 of the mold stripping equipment 3 is then extended to raise the tray 50 so as to have it abut the bottom of the drag flask 13 (FIG. 9(A)).

The fifth cylinders 32 are then contracted so as to pressurize push downward the mold within the cope flask 12 by means of the upper squeeze member 14, while the tenth cylinder 51 is contracted. The ninth cylinders 48 are then extended to lower the tray 50 to pull out the upper mold and the lower mold from the cope flask 12 and the drag flask 13. The fifth cylinders 32 are then extended to raise the upper squeeze member 14 (FIG. 9(B)).

The extruder 52 is then operated to push out the stacked upper and lower molds onto the tray 50 (FIG. 9(C)). Consequently, the stacked, flaskless upper and lower molds are obtained.

Although the present invention has been described herein with reference to an exemplary embodiment, the invention is not intended to be limited to the particulars disclosed herein. Those skilled in the art will recognize that many variations or modifications can be made within the spirit and scope of the present invention, which is defined by the appended claims.

The invention claimed is:

1. A molding machine to mold a pair of flaskless molds, comprising:

a first flask and a second flask;

a carrier plate for holding an exchangeable match plate, said match plate having a first face and a second face corresponding to the first flask and the second flask respectively, wherein said match plate is adapted to be held between the first flask and the second flask in a sandwich relationship;

a pivotable frame mounted for rotation on the machine, the second flask being mounted on a lower part of the frame;

a pair of guide rods attached to the pivotable frame and on which said first flask and carrier plate are slidably supported and means for relatively moving the first flask and the carrier plate on said guide rods with respect to each other and said second flask so that the first and second flasks can hold and release said match plate being held therebetween;

a first squeeze member having a first pressure-applying plane, wherein the first squeeze member is insertable into the first flask while the first pressure-applying plane is opposed to the first face of said match plate, and first inserting means for inserting the first squeeze member into the first flask when the first flask and the second flask hold said match plate therebetween in a sandwich relationship to define a first mold cavity by the first pressure-applying plane, the first face of the match plate, and the first flask, said first squeeze member and first inserting means being supported on the pivotable frame for movement with the first flask;

means for rotating the pivotable frame between a first position in which the first flask and the second flask are in a horizontal position and hold said match plate therebetween in the sandwich relationship while the first pressure-applying plane of the first squeeze member is oriented vertically and facing downward and a second position in which the first flask and the second flask are in a vertical position and hold said match plate therebetween in the sandwich relationship and the first pressure-applying plane is oriented horizontally;

a filling frame located to abut the second flask in a perpendicular position of said filling frame when the first and second flasks hold said match plate therebetween in the sandwich relationship at said second position of the pivotable frame;

a second squeeze member having a second pressure-applying plane that is oriented horizontally, and wherein the second squeeze member is insertable into said filling frame, and second inserting means for inserting the second squeeze member into the second flask through said filling frame when the first and second flasks hold said match plate therebetween while the second pressure-applying plane is opposed to the second face of said match plate at said second position of the pivotable frame to define a second mold cavity by the second pressure-applying plane, the second face of said match plates, said filling frame, and the second flask;

means for introducing molding sand into said defined first and second mold cavities while the first and second flasks hold said match plate therebetween at said second position of the pivotable frame, wherein the first and second flasks have sand filling ports on side walls thereof for introducing the molding sand into the mold cavities, and wherein said means for introducing the molding sand includes a fluidizing mechanism for fluidizing the molding sand with an airflow of compressed air;

a first actuator to move the first squeeze member to the first face of said match plate such that molding sand within the first mold cavity is squeezed by the first pressure-applying plane of said inserted first squeeze member; and a second actuator to move the second squeeze member to the second face of said match plate such that molding sand within the second mold cavity is squeezed by the second pressure-applying plane of the inserted second squeeze member.

2. The molding machine of claim 1, wherein the first flask is a cope flask and the second flask is a drag flask.

3. The molding machine of claim 2, wherein the first mold cavity is defined by the first pressure-applying plane of the first squeeze member, the first face of said match plate, and the first flask, while the pivotable frame on which the first and second flasks, said carrier plate on which said match plate is held, the first squeeze member and the first inserting means are supported is being rotated from said first position to said second position.

4. The molding machine of claim 3, wherein the second squeeze member is inserted into said filling frame by said second inserting means while said pivotable frame rotates from said first position to said second position, and wherein the second mold cavity is defined by the second pressure-applying plane of the second squeeze member, the second face of said match plate, and the second flask when said filling frame abuts the second flask.

5. The molding machine of any one of claim 2, 3, or 4, wherein the first and second actuators include a hydraulic cylinder or an electrical cylinder.

6. The molding machine of any one of claim 1, 2 or 3, further including a shuttle for carrying in and carrying out said carrier plate holding a match plate from between the first flask and the second flask when the pivotable frame is at said first position.

7. The molding machine of any one of claim 1, 2 or 3, further including means for stripping a pair of formed molds from the first and second flasks.

8. The molding machine of claim 7, wherein said means for stripping a pair of molds includes means for pushing out the molds from the first flask and the second flask, which are in a stacked relationship and which contain a pair of the flaskless molds.

* * * * *